US008511797B2

(12) United States Patent
Kobayashi

(10) Patent No.: US 8,511,797 B2
(45) Date of Patent: Aug. 20, 2013

(54) LIQUID EJECTION HEAD AND LIQUID EJECTION APPARATUS

(75) Inventor: Yutaka Kobayashi, Ikeda-machi (JP)

(73) Assignee: Seiko Epson Corporation, Tokyo (JP)

( * ) Notice: Subject to any disclaimer, the term of this patent is extended or adjusted under 35 U.S.C. 154(b) by 310 days.

(21) Appl. No.: 13/023,702

(22) Filed: Feb. 9, 2011

(65) Prior Publication Data

US 2011/0199435 A1 Aug. 18, 2011

(30) Foreign Application Priority Data

Feb. 17, 2010 (JP) ..... 2010-032151

(51) Int. Cl.
*B41J 2/05* (2006.01)
*B41J 2/04* (2006.01)
*B41J 2/045* (2006.01)

(52) U.S. Cl.
USPC ..... 347/65; 347/54; 347/68

(58) Field of Classification Search
None
See application file for complete search history.

(56) References Cited

U.S. PATENT DOCUMENTS 3,946,398 A * 3/1976 Kyser et al. ..... 347/70
6,270,205 B1 8/2001 Takata
6,296,351 B1 * 10/2001 Tanaka et al. ..... 347/68

FOREIGN PATENT DOCUMENTS

JP 10-272770 10/1998
JP 2000-062164 2/2000

* cited by examiner

*Primary Examiner* — Geoffrey Mruk
(74) *Attorney, Agent, or Firm* — Workman Nydegger

(57) ABSTRACT

An ink introducing port is provided on the upstream side of the center of a row of pressure chambers in the direction of gravity g, the pressure due to ink introduction is applied to a region where the influence by the head is small.

5 Claims, 7 Drawing Sheets

LIQUID EJECTION HEAD AND LIQUID EJECTION APPARATUS

CROSS REFERENCES TO RELATED APPLICATIONS

The present invention contains subject matter related to Japanese Patent Application No. 2010-032151 filed in the Japanese Patent Office on Feb. 17, 2010, the entire contents of which are incorporated herein by reference.

BACKGROUND

1. Technical Field

The present invention relates to liquid ejection heads and liquid ejection apparatuses.

2. Related Art

A typical liquid ejection head is disclosed in JP-A-2000-62164, in which ink is supplied from ink introducing ports to a plurality of pressure chambers through reservoirs, which are manifolds. The reservoirs are common ink chambers for supplying ink to the respective pressure chambers and are formed in an elongated shape extending in the direction of rows of the pressure chambers. Furthermore, as disclosed in JP-A-10-272770, the ink jet recording head of an ink jet recording device, which is a liquid ejection apparatus, is disposed at an angle of 45 degrees or perpendicularly.

However, when the liquid ejection head of a liquid ejection apparatus is disposed such that rows of nozzles are inclined or perpendicular to the horizontal direction, the head due to the length of the manifolds in the direction of rows of the pressure chambers causes pressure distribution in the manifolds. This pressure distribution distributes pressure changes among the pressure chambers, which varies the liquid ejection characteristics of the respective nozzle openings and the amount of ejected liquid.

SUMMARY

A liquid ejection head includes a nozzle row including a plurality of nozzle openings through which liquid is ejected; an ejection surface disposed such that the nozzle row forms an angle with respect to the horizontal direction; pressure chambers each communicating with one of the corresponding nozzle openings; pressure generating members that change the pressures in the pressure chambers; a manifold serving as a common liquid chamber that supplies liquid to the plurality of pressure chambers through supply ports; and a liquid introducing port through which liquid is introduced to the manifold, the liquid introducing port being provided at a position between the center of a row of the pressure chambers and a first end located on the upstream side in the direction of gravity.

Furthermore, a liquid ejection apparatus includes the above-described liquid ejection head, the ejection surface of the liquid ejection head being disposed such that the nozzle row forms an angle with respect to the horizontal direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
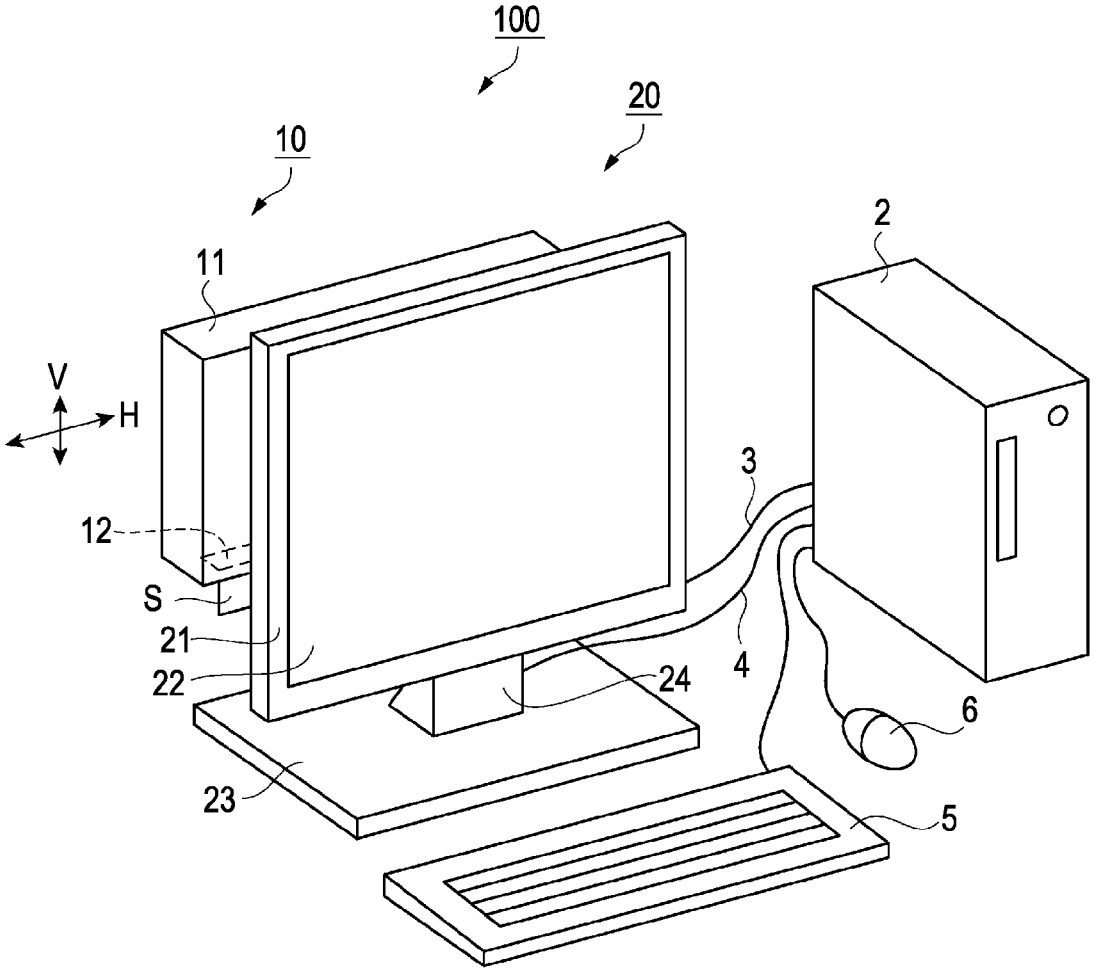
FIG. 1 is an external perspective view of an electronic apparatus including an ink jet recording device according to a first embodiment of the invention.

Referring to the drawings, the embodiments of the invention will be described in detail below.

First Embodiment

FIG. 1 is an external perspective view of an electronic apparatus 100 including an ink jet recording device 10 according to this embodiment, which is an example of a liquid ejection apparatus.

The ink jet recording device 10 sends a recording medium S in the vertical direction V and performs recording. Herein, the recording medium S may be sent at an angle with respect to the vertical direction V. FIG. 1 shows the vertical direction V and the horizontal direction H.

In FIG. 1, the electronic apparatus 100 includes the ink jet recording device 10 and a display 20. In this embodiment, the ink jet recording device 10 is disposed behind the display 20, thereby achieving a space-saving configuration.

The ink jet recording device 10 discharges a recording medium S from an opening 12 provided at the bottom of a main body 11. Herein, the opening 12 may be provided at the top of the main body 11. In such a case, the recording medium S is discharged from the top.

The ink jet recording device 10 performs printing on the recording medium S in the main body 11 on the basis of the printing information, such as gradations of black, yellow, magenta, and cyan, transmitted from a computer 2 through a print signal cable 3.

A main body 21 of the display 20 includes a liquid crystal panel 22 and is supported by a base 23 and a support 24. The display 20 displays an image on the liquid crystal panel 22 on the basis of the display information, such as gradations of red (R), green (G), and blue (B), transmitted from the computer 2, serving as a control unit, through a display signal cable 4.

Figure 2:
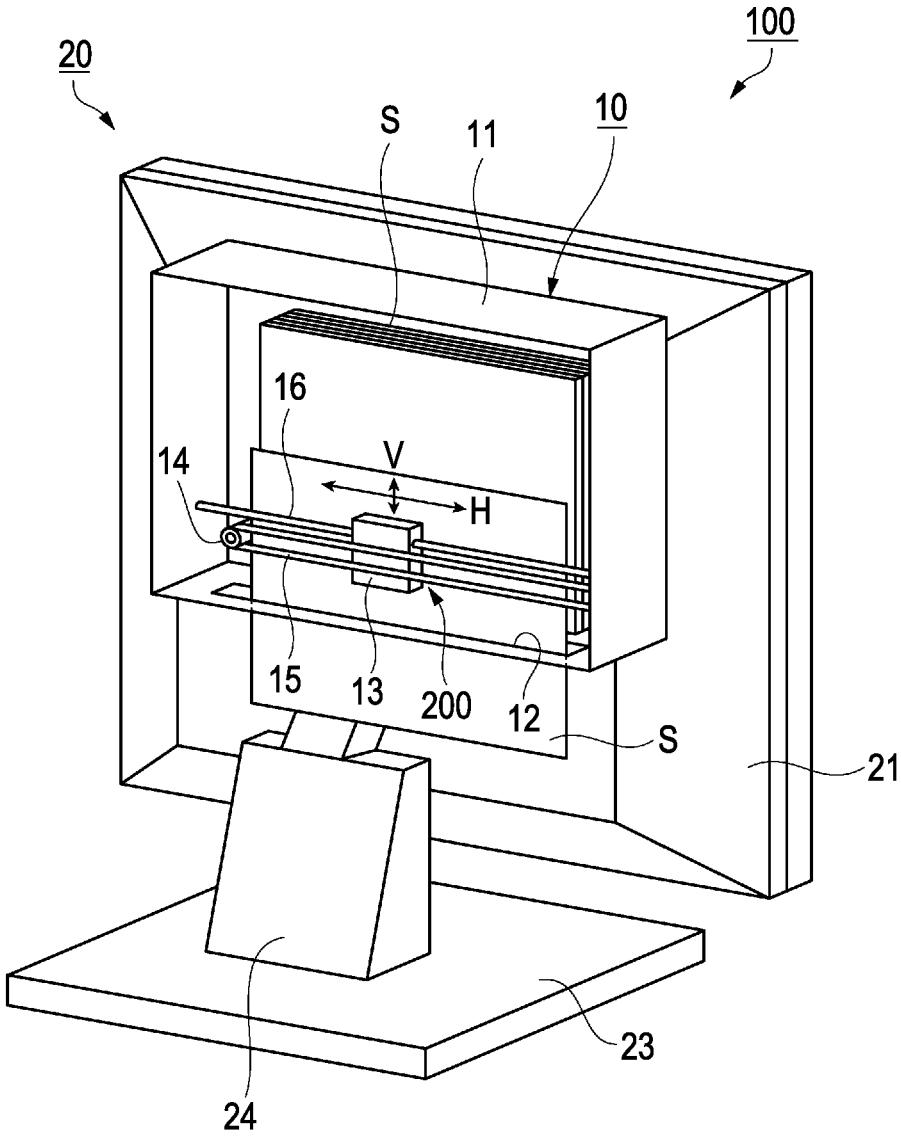
FIG. 2 is an external perspective view of the ink jet recording device and the electronic apparatus of the invention, viewed from the back of a display.

FIG. 2 is an external perspective view of the ink jet recording device 10 and the electronic apparatus 100, viewed from the back of the display 20. FIG. 2 shows the inside of the ink jet recording device 10 by removing a rear cover (not shown) of the ink jet recording device 10.

In FIG. 2, the ink jet recording device 10 includes an ink jet recording head 200, serving as a liquid ejection head. FIG. 2 does not show the ink jet recording head 200 because it is mounted on a carriage 13 so as to face the recording medium S.

Furthermore, ink cartridges (not shown) filled with yellow, magenta, cyan, and black inks are also mounted on the carriage 13.

The carriage 13 is connected to a timing belt 15 rotated in accordance with the rotation of a carriage driving motor 14 and reciprocates in the horizontal direction H along a slid shaft 16. The ink jet recording head 200 also reciprocates in the horizontal direction H along with the reciprocation of the carriage 13.

On the upstream side of the ink jet recording head 200, a sheet feed roller driven by a sheet feed motor (not shown) and a driven roller that is freely rotated are disposed so as to nip the recording medium S, by which the recording medium S is fed to the ink jet recording head 200. On the downstream side of the ink jet recording head 200, a sheet discharging roller (not shown) that is rotated by the sheet feed motor and a driven roller that is freely rotated are disposed so as to nip the recording medium S, by which the recording medium S is discharged.

The carriage 13 includes a linear encoder (not shown) that outputs pulse signals corresponding to the moving distance in the horizontal direction H, so that it can control the position of the ink jet recording head 200 in the horizontal direction H. The scanning direction of the carriage 13 is referred to as a main scanning direction. In this embodiment, the horizontal direction H is the main scanning direction.

On the other hand, the sheet feed motor includes a rotary encoder (not shown) that outputs pulse signals corresponding to the number of revolutions. The feeding amount of the recording medium S in the conveying direction can be controlled by this rotary encoder. The term "sub-scanning" means to move the recording medium S in the conveying direction by a predetermined feeding amount, and the term "sub-scanning direction" means the conveying direction. In this embodiment, the vertical direction V corresponds to the sub-scanning direction.

In FIG. 1, it is possible to cause the ink jet recording device 10 to print images or to cause the display 20 to display images by operating a keyboard 5 or a mouse 6.

Figure 3:
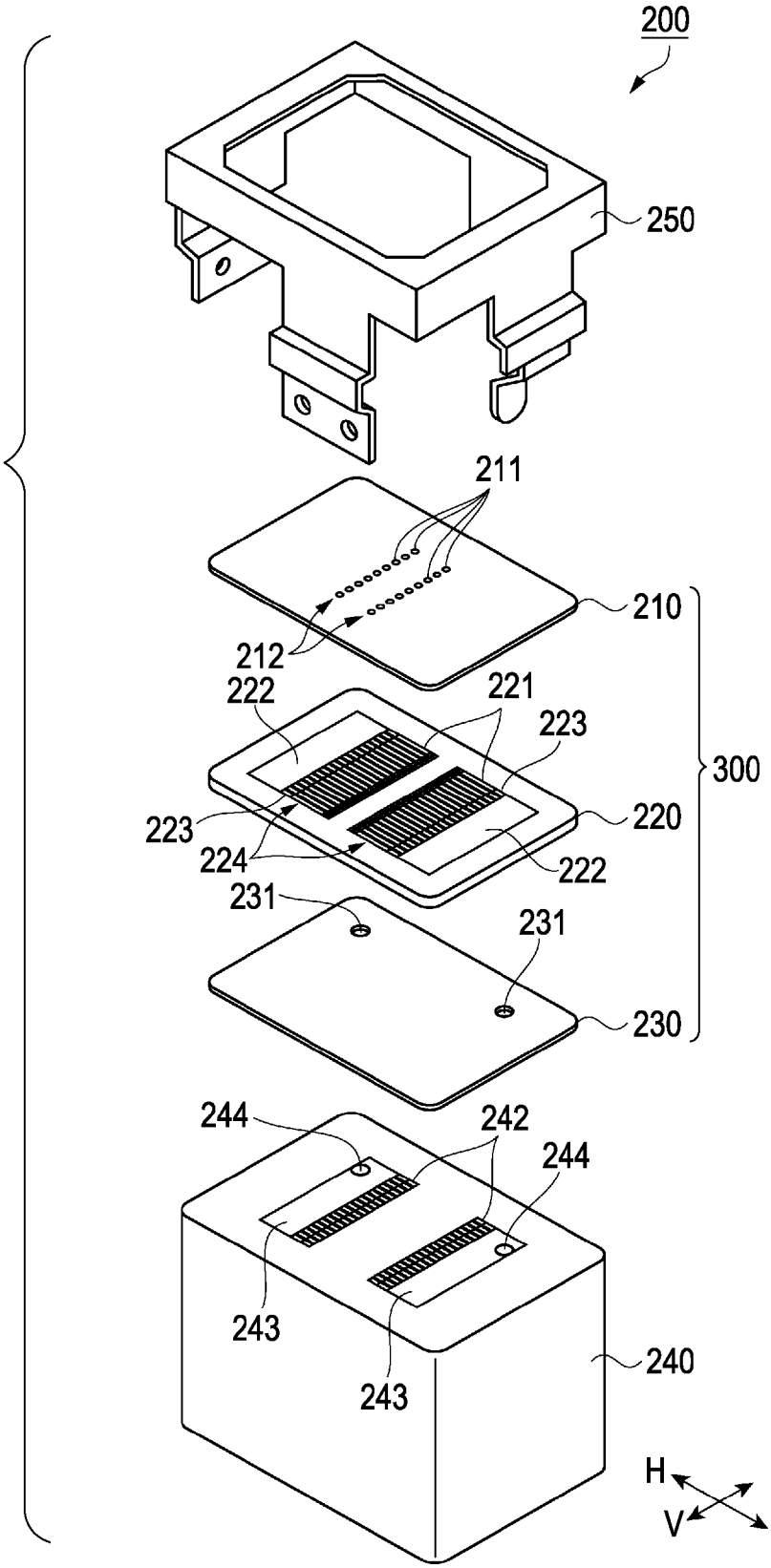
FIG. 3 is an exploded perspective view of an ink jet recording head of the invention.
Figure 4:
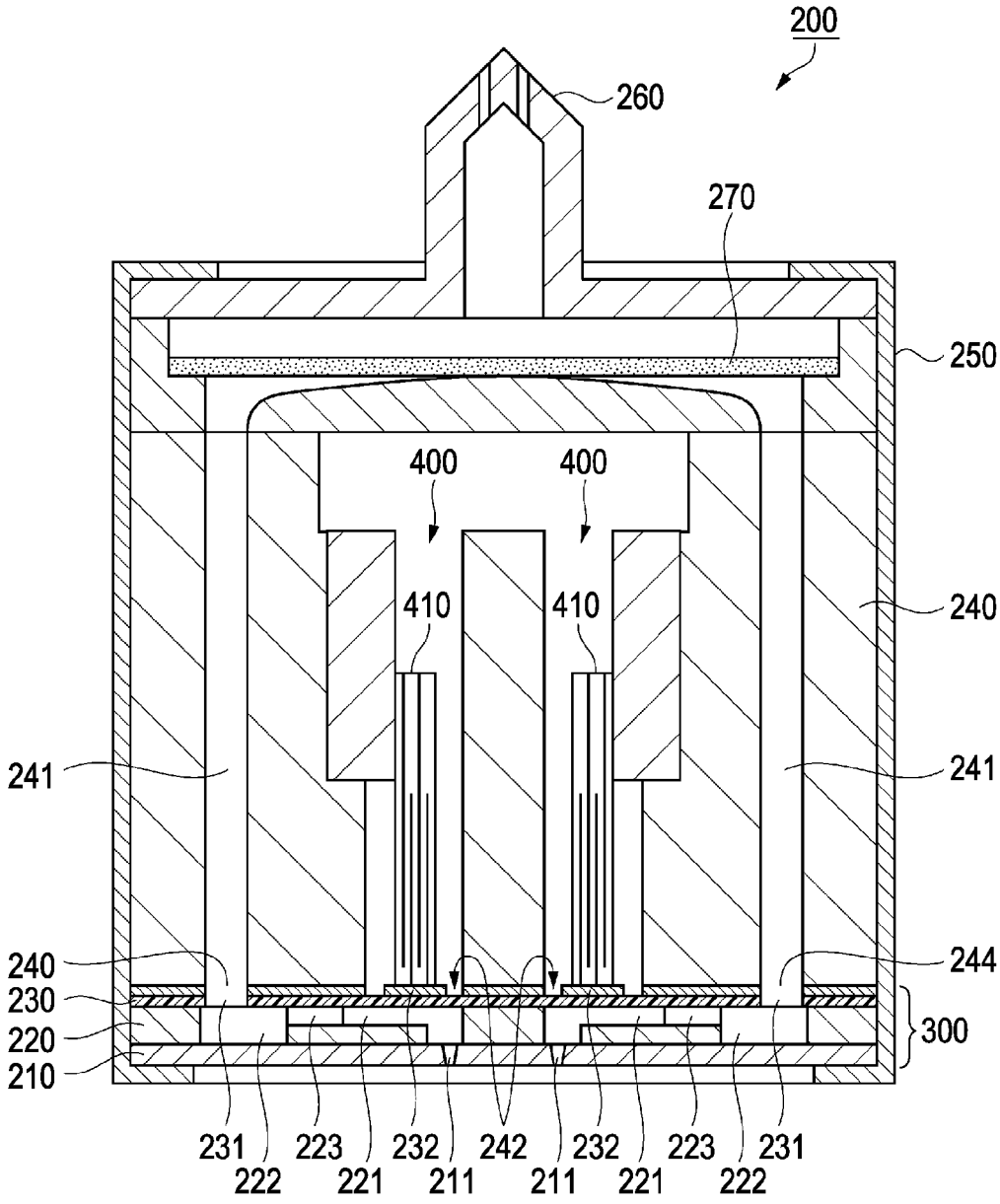
FIG. 4 is a schematic cross-sectional view of the ink jet recording head of the invention.

FIG. 3 is an exploded perspective view of the ink jet recording head 200, and FIG. 4 is a schematic cross-sectional view of the ink jet recording head 200.

In FIGS. 3 and 4, the ink jet recording head 200 includes a nozzle plate 210, a spacer 220, an elastically deformable elastic plate 230, a head holder 240, and a frame 250.

Herein, the nozzle plate 210, the spacer 220, and the elastic plate 230 constitute a flow path forming unit 300.

The nozzle plate 210, serving as the ejection surface of the head 200, has a plurality of nozzle openings 211. The nozzle openings 211 are provided in lines, forming two nozzle rows 212. The nozzle rows 212 are provided in the sub-scanning direction, i.e., the vertical direction V in FIGS. 1 and 2, and are provided at, for example, 90 degrees with respect to the horizontal direction H.

Part of pressure chambers 221 each communicating with the corresponding one of the nozzle openings 211 and part of two manifolds 222, which are common liquid chambers for supplying ink to the pressure chambers 221, is formed in the spacer 220. Part of ink supply ports 223, serving as supply ports, is formed between the pressure chambers 221 and the manifolds 222. Ink is distributed from the manifolds 222 to the pressure chambers 221 through the ink supply ports 223.

The pressure chambers 221 constitute two rows 224 of the pressure chambers, similarly to the nozzle openings 211.

The spacer 220 is made of a silicon single crystal substrate cut to a predetermined thickness, in which part of manifolds 222 in the form of through-holes is formed by anisotropic full-etching and in which the pressure chambers 221 and the ink supply ports 223 in the form of recesses are formed by anisotropic half-etching.

Alternatively, the spacer 220 may be made of an ink-resistant metal or glass plate that can be etched, and through-regions and recesses may be formed therein by etching. Or, the spacer 220 may be formed by dividing it into a plurality of layers in the thickness direction at least at the bottom surfaces of the recesses, and stacking etching films having through-holes that correspond to the through-holes in the respective layers.

The flow path forming unit 300 is formed by stacking the nozzle plate 210, the spacer 220, and the elastic plate 230. The nozzle plate 210 and the elastic plate 230 constitute, in part, the pressure chambers 221, the manifolds 222, and the ink supply ports 223. Thus, the pressure chambers 221, the manifolds 222, and the ink supply ports 223 are formed by stacking these plates.

The flow path forming unit 300 is made by fixing the nozzle plate 210 to one side of the spacer 220 and the elastic plate 230 to the other side thereof with an adhesive or the like in a liquid-tight manner.

In FIG. 4, piezoelectric vibrator units 400 having piezoelectric vibrators 410, serving as pressure generating members, are attached to the head holder 240. In addition, ink guide paths 241 are formed in the head holder 240.

Furthermore, in FIGS. 3 and 4, the head holder 240 has windows 242, through which the piezoelectric vibrators 410 are exposed, formed at positions facing the pressure chambers 221 and has recesses 243, which allow deformation of the elastic plate 230, formed at regions facing the pressure chambers 221 and the manifolds 222. The head holder 240 also has openings 244 of the ink guide paths 241 at positions facing the manifolds 222.

The elastic plate 230 has ink introducing ports 231, serving as liquid introducing ports, through which ink is introduced from the openings 244 of the ink guide paths 241 to the manifolds 222. The elastic plate 230 also has rigid island portions 232 formed on the center lines of the pressure chambers 221 such that the volume of the pressure chambers 221 is changed over wide areas. The tips of the piezoelectric vibrators 410 are in contact with the island portions 232.

The ink jet recording head 200 may be assembled as follows.

First, the flow path forming unit 300 is fixed to the head holder 240 with an adhesive or the like after the ink introducing ports 231 are aligned with the openings 244 of the ink guide paths 241 in the head holder 240.

Next, the piezoelectric vibrator units 400 are fixed to the head holder 240 such that the tips of the piezoelectric vibrators 410 are in contact with the island portions 232 of the elastic plate 230.

Finally, an ink supply needle 260 for supplying ink from the ink cartridge (not shown) and a filter 270 are attached to the other side of the head holder 240, and then the outer side thereof is fixed by a frame 250, which also serves as a shield member, to complete the ink jet recording head 200.

Figure 5:
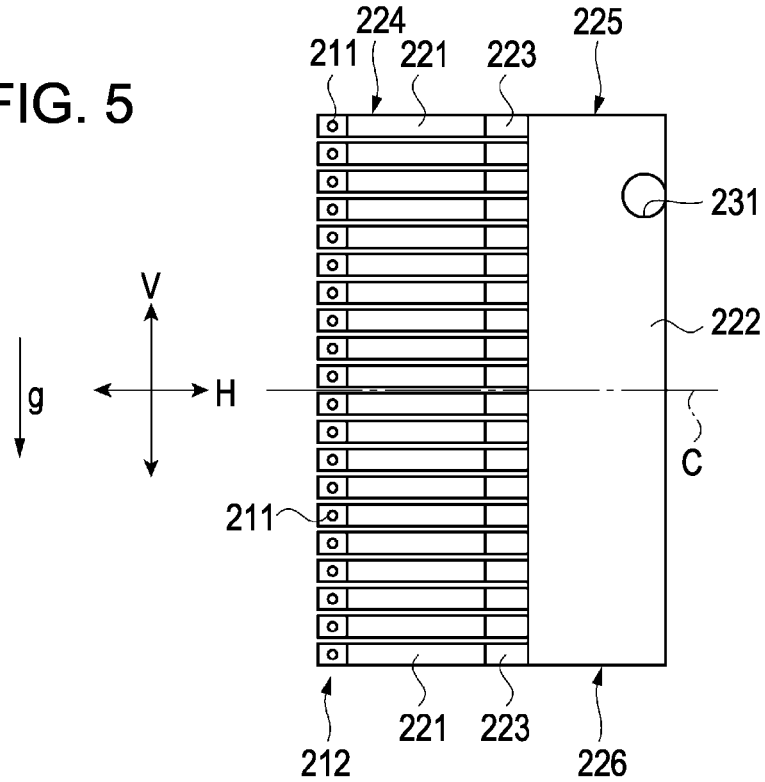
FIG. 5 is a schematic plan view showing the positional relationship between an ink introducing port and a portion constituting a manifold, ink supply ports, and pressure chambers in the invention.

FIG. 5 is a schematic plan view showing the positional relationship between the ink introducing port 231 and the portion constituting the manifold 222, the ink supply ports 223, and the pressure chambers 221.

Although the manifolds 222, the ink supply ports 223, the pressure chambers 221, and the ink introducing ports 231 are provided so as to correspond to two rows of the nozzle rows 212, FIG. 5 shows those corresponding to one row. Herein, the number of pressure chambers 221 and ink supply ports 223 is not limited to that shown in FIG. 5.

In FIG. 5, the direction of gravity g is shown in addition to the vertical direction V and the horizontal direction H. The direction of gravity g is from top to bottom in the plane of the sheet of FIG. 5. In FIGS. 1 and 2, the recording medium S is discharged in the direction of gravity.

FIG. 5 also shows the center line C that passes the center of the rows 224 of the pressure chambers 221 corresponding to the nozzle rows 212 and that divides the nozzle rows 212 and the pressure chambers 221 into two.

In FIG. 5, the pressure chambers 221 are formed at predetermined intervals, and the manifold 222 is formed at a side of the pressure chambers 221. The manifold 222 is rectangular in plan view. The ink introducing port 231 is provided at a position between the center of the rows 224 of the pressure chambers 221 and a first end 225 located on the upstream side in the direction of gravity g.

Herein, the ink introducing port 231 is not provided at the first end 225 because, if there is the ink introducing port 231 near the wall of the first end 225, ink is pushed back by the wall, which significantly varies the pressure and makes it difficult to achieve uniform pressure in the manifold 222.

Referring to FIGS. 3 and 4, when a driving signal is applied to the ink jet recording head 200, the piezoelectric vibrators 410 contract, and the pressure chambers 221 expand. This causes ink in the manifolds 222 to flow from the ink supply ports 223 to the pressure chambers 221.

The piezoelectric vibrators 410 are allowed to discharge after a predetermined period of time has elapsed. As a result, the piezoelectric vibrators 410 extend and return to the original state. In this process, the pressure chambers 221 are compressed to increase the pressure, discharging part of ink in the pressure chambers 221 from the nozzle openings 211 as ink droplets.

Conventional Example

Figure 6:
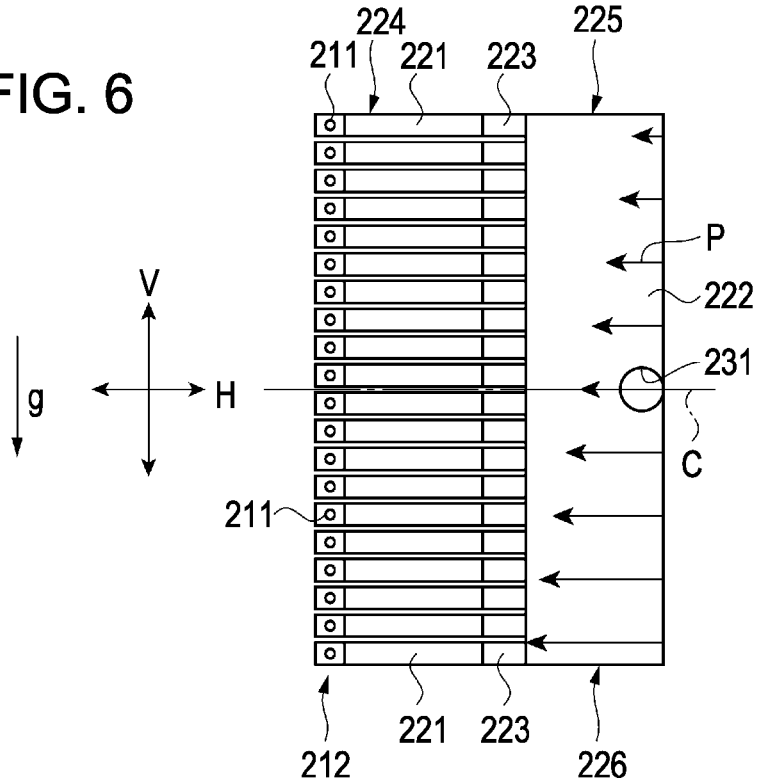
FIG. 6 is a schematic plan view showing the positional relationship between an ink introducing port and a portion constituting a manifold, ink supply ports, and pressure chambers in the conventional example.

FIG. 6 is a schematic plan view showing the positional relationship between the ink introducing port 231 and the portion constituting the manifold 222, the ink supply ports 223, and the pressure chambers 221 in the conventional ink jet recording head 200, which is used such that the nozzle row 212 extends in the horizontal direction H. The same components are denoted by same reference numerals.

In FIG. 6, the manifold 222 is rectangular in plan view, as in the first embodiment. In the conventional example, the position of the ink introducing port 231 with respect to the manifold 222, the ink supply ports 223, and the pressure chambers 221 is on the center line C. The ink introducing port 231 is located on the center line C because this configuration makes the pressure distribution of ink in the manifold 222 with respect to the ink supply ports 223 symmetrical, thereby reducing the pressure difference between locations as much as possible, when the nozzle row 212 extends in the horizontal direction H.

FIG. 6 shows the case where the conventional ink jet recording head is used such that the nozzle rows 212 extend in the direction of gravity g.

The arrows in FIG. 6 show the head P applied to the ink supply ports 223, in the manifold 222. The lengths of the arrows represent the magnitude of the head P. The head P increases in the direction of gravity g.

Figure 7:
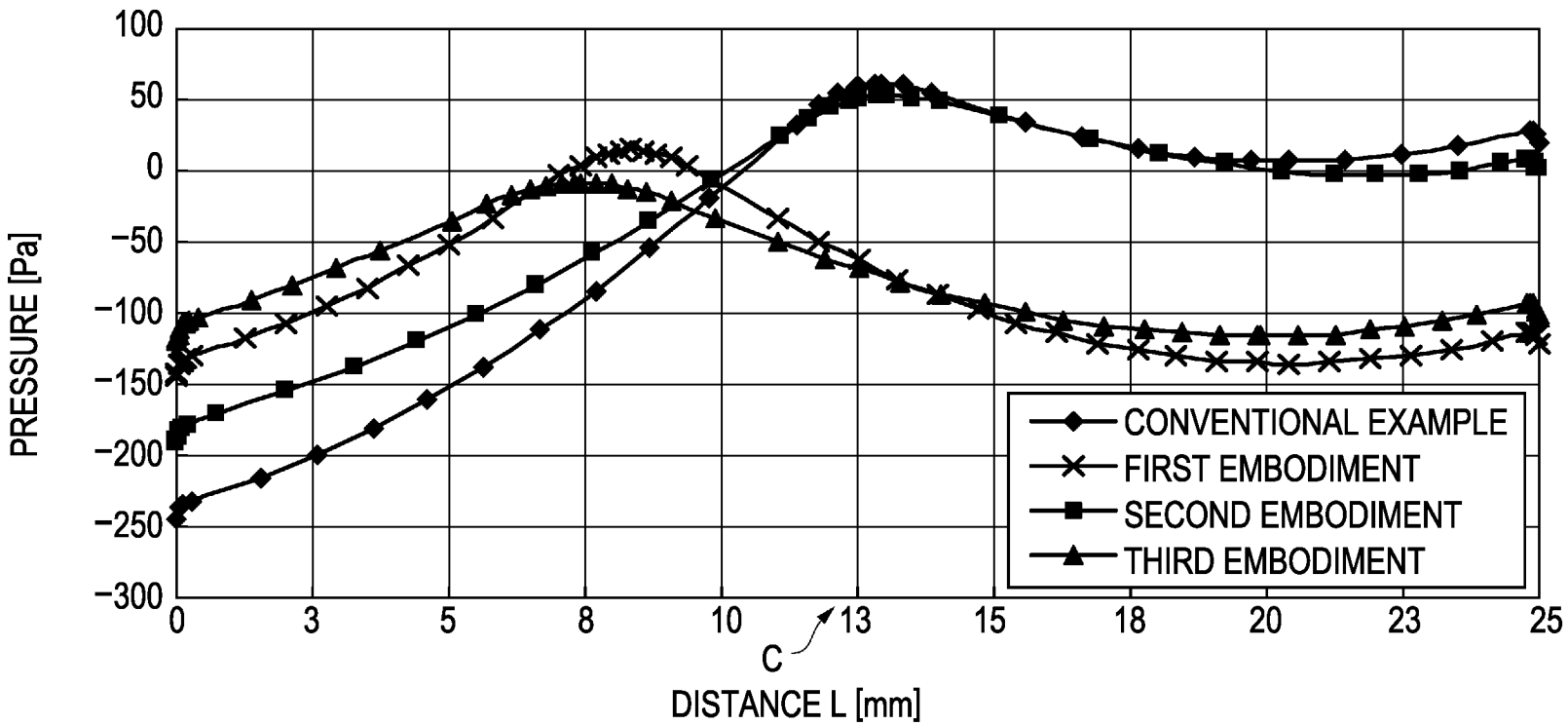
FIG. 7 is a graph showing pressure distributions at the ink supply ports according to the conventional example and the embodiments of the invention.

FIG. 7 is a graph showing pressure distributions in the manifolds 222, near the ink supply ports 223, in the conventional example and the invention. The graph shows the pressure distributions when the piezoelectric vibrators 410 are driven.

In FIG. 7, the horizontal axis represents the distance from the first end 225, shown in FIGS. 5 and 6, and the vertical axis represents the pressure. The position of the center line C is denoted by "C".

In the conventional example, there is a large negative pressure near the first end 225 because ink is drawn in the direction of gravity g, and the pressure increases toward the center line C. On the other hand, the pressure does not decrease too much even if the distance from the center line C in the direction of gravity g increases, because the influence of the head P is greater than the decrease in pressure due to the flow path resistance.

Meanwhile, in the embodiments of the invention, the negative pressure does not increase too much near the first end 225 because of the ink introducing port 231 provided in the vicinity thereof and the pressure of flowing ink applied thereto. On the other hand, the pressure decreases due to the flow path resistance as the distance from the center line C in the direction of gravity g increases.

In the conventional example and the embodiments of the invention, slight increases in pressure near a second end 226 located on the downstream side in the direction of gravity g may be due to precision errors. Thus, in the embodiments of the invention, such increases in pressure are ignored.

The embodiments of the invention provides the following advantages.

(1) The pressure applied to the ink in the manifolds 222, which extend along the rows 224 of the pressure chambers 221, increases in the direction of gravity g due to the head P, varying the pressure applied to the ink supply ports 223. However, the ink introducing ports 231 through which the ink is introduced into the manifolds 222 are provided between the center of the rows 224 of the pressure chambers 221 and the first end 225. Because the ink introducing ports 231 are provided on the upstream side of the center of the rows 224 of the pressure chambers 221 in the direction of gravity g, the pressure due to ink introduction is applied to the region where the influence of the head P is small and the pressure is low. In addition, because the distance of the ink introducing ports 231 from the region where the influence of the head P is large and the pressure is high increases, a decrease in pressure due to increased flow path resistance occurs at the region where the influence of the head P is large and the pressure is high. Thus, variations in pressure applied to the ink supply ports 223 can be reduced. Accordingly, it is possible to reduce variations in pressure in the pressure chambers 221 and variations in ink ejecting characteristics among the nozzle openings 211 when ink is ejected from the nozzle openings 211 by changing the pressure in the pressure chambers 221, whereby it is possible to provide the ink jet recording head 200 in which variations in the amount of ejected ink are negligible.

(2) In the invention, the ink jet recording device 10 having the above-described advantages can be obtained.

Second Embodiment

Figure 8:
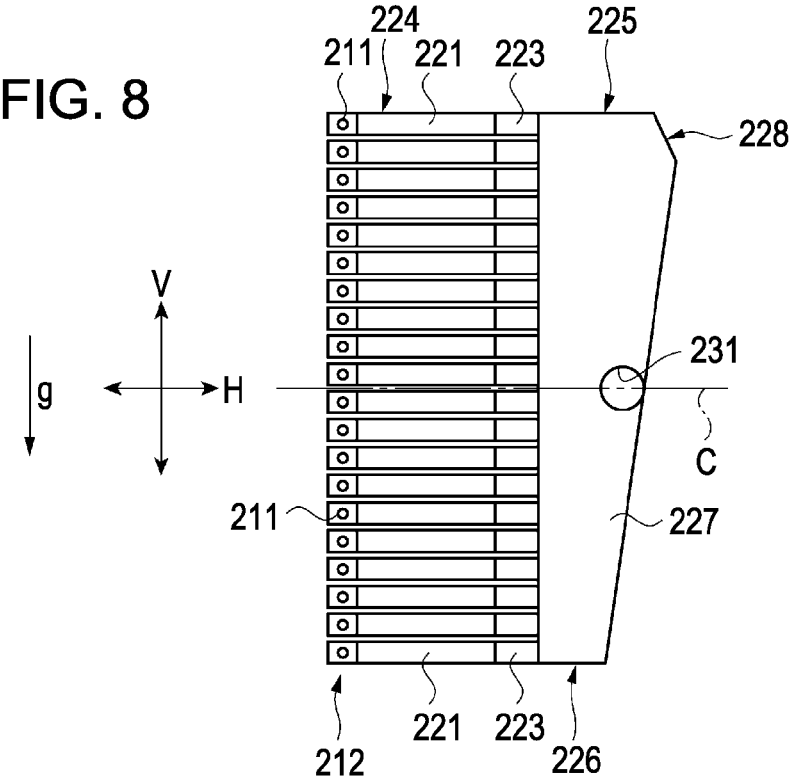
FIG. 8 is a schematic plan view showing the positional relationship between an ink introducing port and a portion constituting a manifold, ink supply ports, and pressure chambers according a second embodiment of the invention.

FIG. 8 is a schematic plan view showing the positional relationship between the ink introducing port 231 and a portion constituting a manifold 227, the ink supply ports 223, and the pressure chambers 221 of the ink jet recording head 200 according to a second embodiment of the invention. The same components having the same shapes as those in the first embodiment are denoted by the same reference numerals.

The manifold 227 in this embodiment is shaped such that, in plan view, the portion from the center of the rows 224 of the pressure chambers 221 to the first end 225 is wider than the portion from the center of the rows 224 of the pressure chambers 221 to the second end 226.

Herein, a plurality of (herein, two) corners are provided at a corner portion 228 at the first end 225 such that they form an obtuse angle. Furthermore, the ink introducing port 231 is provided on the center line C.

The ink introducing port 231 is disposed at a position between the center of the rows of the pressure chambers and the second end 226, the position being closer to the center of the row of the pressure chambers than the corner portion. In addition, the distance between the walls of the manifold, i.e., the wall at the pressure chambers and the opposite wall, is largest at the corner near the ink introducing port, among the plurality of corners.

In this embodiment, the flow path resistance increases as the width of the manifold 227 decreases in the direction of gravity g. Although the pressure near the first end 225 is slightly higher than that in the case of the conventional example, the pressure slightly decreases as the distance from the center line C increases in the direction of gravity g due to the flow path resistance.

This embodiment of the invention provides the following advantages.

(3) In FIG. 7, as the width of the manifold 227 decreases in the direction of gravity g, the flow path resistance further increases in the direction of gravity g. This reduces the pressure in the direction of gravity g. Thus, the influence of the head P is reduced, whereby it is possible to reduce variations in ink ejecting characteristics among the nozzle openings 211 and to provide the ink jet recording head 200 and the ink jet recording device 10 in which variations in the amount of ejected ink are negligible.

(4) Because the angles formed by the walls of the manifold 227 are either the right angle or obtuse angles, there are no acute angle portion where bubbles generated in the manifold 227 or entered the manifold 227 can stay. Thus, the growth of the bubbles can be prevented. Accordingly, it is possible to prevent bubbles from clogging the ink supply ports 223 and to prevent a decrease in the amount of ink supply to the pressure chambers 221. Accordingly, it is possible to further reduce variations in ink ejecting characteristics among the nozzle openings 211 and to provide the ink jet recording head 200 and the ink jet recording device 10 in which variations in the amount of ejected ink are negligible.

Third Embodiment

Figure 9:
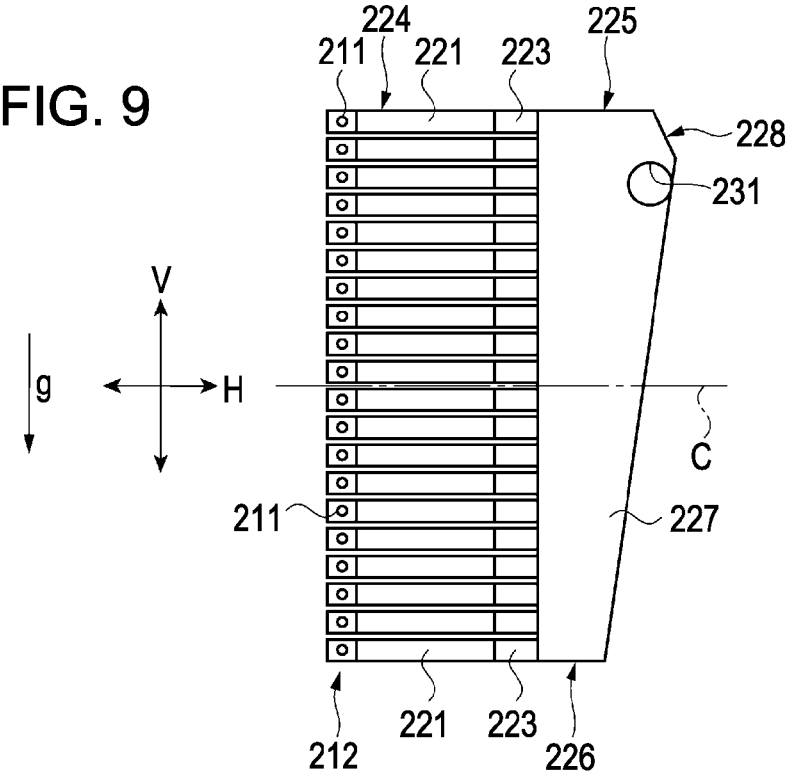
FIG. 9 is a schematic plan view showing the positional relationship between an ink introducing port and a portion constituting a manifold, ink supply ports, and pressure chambers according a third embodiment of the invention.

FIG. 9 is a schematic plan view showing the positional relationship between the ink introducing port 231 and the portion constituting the manifold 227, the ink supply ports 223, and the pressure chambers 221 of the ink jet recording head 200 according to the third embodiment. The same components having the same shapes as those in the first and second embodiments are denoted by the same reference numerals.

The shape of the manifold 227 according to this embodiment is the same as that of the second embodiment, and the ink introducing port 231 is provided between the center of the rows 224 of the pressure chambers 221 and the first end 225, similarly to the first embodiment.

This embodiment of the invention provides the following advantage.

(5) In FIG. 7, in addition to the pressure changes in the first embodiment, the advantages in the second embodiment, achieved by the flow path resistance, are obtained. Accordingly, it is possible to further reduce variations in ink ejecting characteristics among the nozzle openings 211 and to provide the ink jet recording head 200 and the ink jet recording device 10 in which variations in the amount of ejected ink are negligible.

Although the embodiments of the invention have been described above, the basic configuration is not limited to that described above.

For example, although the ink jet recording head 200 according to the embodiments utilizes stretching vibration of the piezoelectric vibrators 410, serving as the pressure generating members, to change the volume of the pressure chambers 221, the volume of the pressure chambers 221 may be changed by utilizing deflection vibration of the piezoelectric vibrators.

Furthermore, the pressure generating members may be heat-generating elements disposed in the pressure chambers, which eject liquid droplets from the nozzle openings using bubbles produced by the heat generated by the heat-generating element, or so-called electrostatic actuators, in which static electricity is generated between a diaphragm and an electrode to deform the diaphragm by the electrostatic force and cause liquid droplets to be ejected from the nozzle openings.

Although the description has been given taking the ink jet recording head 200 as an exemplary application of the liquid ejection head, the other examples of the liquid ejection head to which the invention can be applied include color material ejection heads used in production of color filters for liquid crystal displays and the like; electrode material ejection heads used for forming electrodes of organic EL displays, field emission displays (FEDs) and the like; and living organic ejection heads used in production of biochips.

What is claimed is:

1. A liquid ejection head comprising:

a nozzle row including a plurality of nozzle openings through which liquid is ejected;

an ejection surface disposed such that the nozzle row forms an angle with respect to the horizontal direction;

pressure chambers each communicating with one of the corresponding nozzle openings;

pressure generating members that change the pressures in the pressure chambers;

a manifold serving as a common liquid chamber that supplies liquid to the plurality of pressure chambers through supply ports; and a liquid introducing port through which liquid is introduced to the manifold, the liquid introducing port being provided at a position between a center of a row of the pressure chambers and a first end located on the upstream side in the direction of gravity, the center of the row being defined by a center line that passes through the center of the row in a direction that is perpendicular to the direction of gravity such that the center line divides the row of the pressure chambers into two approximately equal halves.

2. The liquid ejection head according to claim 1, wherein, in the manifold, the width of a portion from the center of the row of the pressure chambers to the first end is larger than the width of a portion from the center of the row of the pressure chambers to a second end located on the downstream side in the direction of gravity.

3. The liquid ejection head according to claim 2, wherein the manifold has a corner portion at the first end, the corner portion including a plurality of corners such that the angle of the corner portion is an obtuse angle.

4. The liquid ejection head according to claim 3, wherein the liquid introducing port is disposed at a position between the center of the row of the pressure chambers and the second end, the position being closer to the center of the row of the pressure chambers than the corner portion.

5. A liquid ejection apparatus comprising the liquid ejection head according to claim 1.

* * * * *